US006127984A

United States Patent [19]

Klebe et al.

[11] Patent Number: 6,127,984

[45] Date of Patent: Oct. 3, 2000

[54] FLARED NOTCH RADIATOR ASSEMBLY AND ANTENNA

[75] Inventors: Douglas O. Klebe; Lan Tso, both of Redondo Beach; Jeffrey A. Bille, Torrance; Gary L. Crandall, Los Angeles; Allen Wang, Buena Park, all of Calif.

[73] Assignee: Raytheon Company, Lexington, Mass.

[21] Appl. No.: 09/293,145

[22] Filed: Apr. 16, 1999

[51] Int. Cl.[7] ..... H01Q 13/10

[52] U.S. Cl. ..... 343/770; 343/767

[58] Field of Search ..... 343/770, 771, 343/772, 783, 785, 786, 767, 872, 840; 342/26

[56] References Cited

U.S. PATENT DOCUMENTS 4,571,593 2/1986 Martinson ..... 343/783

4,658,267 4/1987 Roy et al. ..... 343/786

5,264,860 11/1993 Quan ..... 343/767

5,936,589 11/1995 Kawahata ..... 343/785

*Primary Examiner*—Don Wong

*Assistant Examiner*—James Clinger

*Attorney, Agent, or Firm*—Leonard A. Alkov; Glenn H. Lenzen, Jr.

[57] ABSTRACT

An improved injection molded radiator assembly and antenna assembly can be made using multiple such radiator assemblies. The radiator assembly includes an injection molded radiator enclosure that forms an RF waveguide channel. A circuit/RF probe subassembly is mated to the radiator enclosure that houses a circulator assembly, input and output connectors, and an RF probe. An environmental plug is disposed in the radiator enclosure to seal the RF waveguide channel from the external environment.

18 Claims, 1 Drawing Sheet

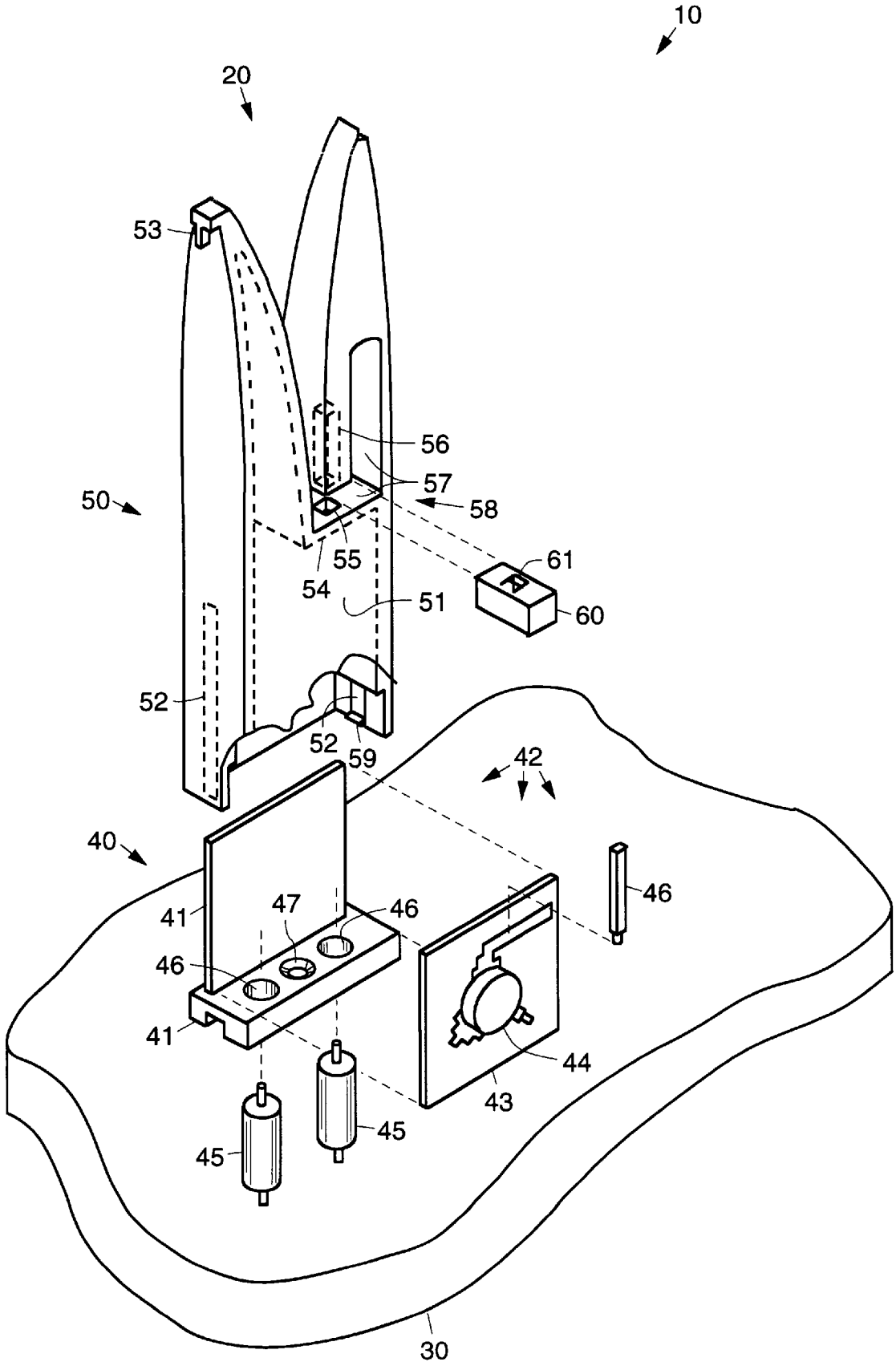
10
20
53
56
57
58
50
55
54
51
61
60
52
52
59
42
40
41
47
46
46
46
41
44
43
45
45
30

FLARED NOTCH RADIATOR ASSEMBLY AND ANTENNA

BACKGROUND

The present invention relates generally to antennas and antenna radiator assemblies, and more particularly, to a conductively plated injection molded plastic radiator assembly and antenna assembly constructed using same.

Conventional flared notch radiator assemblies are machined from aluminum, and are consequently, much heavier than plated plastic. These conventional assemblies are made up of a two piece housing that varies in length. Multiple lengths and quantities are required for different aperture configurations. The conventional approach increases programming, and tooling fabrication costs as well as logistics support. It would be desirable to have a radiator assembly that reduces these costs and minimizes the number of components in the assembly.

The conventional two piece housing exposes an RF probe directly to the environment and can entrap moisture, thereby increasing susceptibility to contaminants and corrosion. It would be desirable to have a radiator assembly that protects the probe and inhibits moisture from entering the enclosure.

Therefore, it is an objective of the present invention to provide for an improved conductively plated injection molded plastic radiator assembly that overcomes limitations in conventional designs and permits the construction of improved array antennas, and the like.

SUMMARY OF THE INVENTION

The present invention provides for an improved conductively plated injection molded plastic radiator assembly. Multiple radiator assembly are secured to an aperture plate to form an antenna. The radiator assembly is comprised of three parts, namely, a circuit/RF probe subassembly, a radiator enclosure into which the circuit/RF probe subassembly is secured, and a molded, moisture resistant, low loss dielectric environmental plug.

The radiator assembly is designed as a single unit, which reduces the tolerance stack-up associated with machined aluminum radiator strips, and permits unlimited aperture configurations. The design of the radiator assembly inhibits moisture from entering the enclosure. Unique features of this self contained radiator assembly include its light weight, moisture resistance and ease of assembly and installation.

The radiator enclosure is preferably injected molded using a suitable engineering thermoplastic material that is conductively plated using electroless plating technologies. This enclosure has pockets to reduce weight and provide a waveguide channel and an alignment fixture during final assembly. The enclosure has a tab which interlocks to a neighboring radiator assembly upon installation. This feature assists in alignment during installation and improves the overall rigidity of the antenna aperture.

Prior to final radiator assembly, the environmental plug is inserted into an RF channel section of the radiator enclosure. The plug seals the RF channel from the external environment. The circuit subassembly is then inserted into the radiator enclosure and the assembly is secured to the aperture plate.

BRIEF DESCRIPTION OF THE DRAWINGS

The various features and advantages of the present invention may be more readily understood with reference to the following detailed description taken in conjunction with the accompanying drawing FIGURE, which is an exploded view of an exemplary radiator assembly in accordance with the principles of the present invention.

DETAILED DESCRIPTION

Referring to the drawing FIGURE, it is an exploded view of an exemplary radiator assembly 10 in accordance with the principles of the present invention. The radiator assembly 10 is comprised of a flared notch radiator assembly 10 having a flared notch radiator element 20. The flared notch radiator assembly 10 is a conductively-plated injection-molded plastic radiator assembly 10. Multiples of the radiator assembly 10 mount to an aperture plate 30 of an antenna, shown schematically as a flat plate. The radiator assembly 10 comprises three parts, including a circuit/RF probe subassembly 40, a radiator enclosure 50, and an environmental plug 60.

The circuit/RF probe subassembly 40 includes an aluminum carrier 41 onto which a circulator assembly 42 comprising an alumina substrate 43 attached thereto that has a circulator 44, two coaxial input/output connectors 45, and an RF probe 46 mounted thereto. The aluminum carrier 41 is T-shaped and provides rigidity for the entire circuit/RF probe subassembly 40 as well as a thermal path to transfer the heat generated by the circulator assembly 42 to the aperture plate 30. The carrier 41 also has two holes 46 for the coaxial input/output connectors 45 and a threaded mounting hole 47 for securing it to the aperture plate 30. The alumina substrate 43 has a plurality of circuits 48 formed thereon that are used to couple energy through the radiator assembly 10.

The radiator enclosure 50 is preferably injected molded using a suitable engineering thermoplastic material that is conductively plated using electroless plating processes. The radiator enclosure 50 has a pocket 51 which provides a waveguide channel 51 for the RF probe 46, and slots 52 along sides of the enclosure 50 which act as an alignment fixture during final assembly. Two tabs 59 are provided at ends of the slots 52 that hold the circuit/RF probe subassembly 40 in place when the radiator assembly 10 is assembled. The enclosure 50 has a T-shaped tab 53 on an end of one of the flare points which interlocks to a neighboring radiator assembly 10 upon installation. The T-shaped tab 53 assists in alignment during installation and improves the overall rigidity of the antenna aperture.

In the exemplary embodiment shown in the drawing figure, the waveguide channel 51 has a rectangular cross section at the bottom of the enclosure 50 where the circuit/RF probe subassembly 40 is inserted. The waveguide channel 51 extends into the left flared portion of the enclosure 50. The enclosure 50 has an internal wall 54 extending laterally across a portion of the interior of the enclosure 50. The internal wall 54 has an opening 55 through which the probe 46 is inserted, and a cavity 56 in the right flared portion of the enclosure 50 that holds the probe 46. The environmental plug 60 is inserted in an opening between the internal wall 54 and the portion of the enclosure where the cavity 56 is located. An L-shaped cavity 57 is formed in the right flared portion of the enclosure 50 above the internal wall 54.

The circuit/RF probe subassembly 40 is assembled and electrically tested prior to insertion into the radiator enclosure 50. The environmental plug 60, or gasket 60, is disposed in the radiator enclosure 50 and is self-sealing prior to the circuit subassembly 40 is inserted into the radiator enclosure 50 during final assembly. The environmental plug 60 has an opening 61 therein that aligns with the opening 55 in the internal wall 54 of the enclosure 50 and with the cavity 55, into which the probe 46 is inserted.

The environmental plug 60 is preferably a molded, moisture resistant, low loss dielectric plug 60. Prior to final assembly of the radiator assembly 10, the plug 60 is inserted into an RF channel section 58 of the radiator enclosure 50 and the opening 61 therein is aligned with the opening 55 in the internal wall 54 of the enclosure 50 and with the cavity 55. The plug 60 seals the RF channel 51 from the external environment. The circuit/RF probe subassembly 40 is then inserted into the radiator enclosure 50 with the probe 46 inserted through the opening 55 in the internal wall 54 of the enclosure 50, the opening 61 in the plug 60 and into the cavity 56. The assembled circuit/RF probe subassembly 40 is secured by sliding the aluminum carrier 41 along with the substrate 43, probe 46 and input/output connectors 45 into the waveguide section 51 using the slots 52 as guides, and until the circuit/RF probe subassembly 40 is secured by the tabs 59 within the waveguide channel 51. The radiator assembly 10 is secured to the aperture plate 30.

The radiator assembly 10 is designed as a single unit. The radiator assembly 10 reduces the tolerance stack up associated with machined aluminum radiator strips used in conventional devices and permits unlimited aperture configurations. The design of the radiator assembly 10 protects the RF probe 16 and inhibits moisture from entering the enclosure 50. Unique features of the self-contained radiator assembly 10 include its light weight, moisture resistance and ease of assembly and installation.

The present invention may be used with any active array antenna system using flared notch radiators. The present invention is intended to lower the cost, improve the versatility, and improve the performance of antenna systems in which it is employed.

Thus, an improved radiator assembly has been disclosed. It is to be understood that the described embodiment is merely illustrative of some of the many specific embodiments that represent applications of the principles of the present invention. Clearly, numerous and other arrangements can be readily devised by those skilled in the art without departing from the scope of the invention.

What is claimed is:

1. Antenna apparatus comprising:

a radiator enclosure having an RF waveguide channel;

a circuit subassembly mated to the radiator enclosure that comprises a carrier, a circulator assembly, input and output connectors, and an RF probe; and an environmental plug disposed in the radiator enclosure to seal the RF waveguide channel from the external environment.

2. The apparatus recited in claim 1 wherein the radiator enclosure comprises a flared notch radiator element.

3. The apparatus recited in claim 1 wherein the radiator enclosure comprises a conductively plated injection molded plastic radiator enclosure.

4. The apparatus recited in claim 1 wherein the carrier comprises an aluminum carrier.

5. The apparatus recited in claim 1 wherein the carrier provides a thermal path to transfer the heat generated by the circulator assembly.

6. The apparatus recited in claim 1 wherein the carrier comprises two holes for mounting coaxial input and output connectors.

7. The apparatus recited in claim 1 wherein the carrier comprises a threaded mounting hole for securing the circuit subassembly to an aperture plate.

8. The apparatus recited in claim 1 wherein the radiator enclosure comprises conductively plated injected molded thermoplastic material.

9. The apparatus recited in claim 1 wherein the radiator enclosure has a tab on its end.

10. Antenna apparatus comprising:

a plurality of radiator assemblies disposed on an aperture plate, each of the radiator assemblies comprising:

a radiator enclosure that comprises an RF waveguide channel;

a circuit subassembly mated to the radiator enclosure that comprises a carrier, a carrier that secures a circulator assembly, input and output connectors, and an RF probe; and an environmental plug disposed in the radiator enclosure to seal the RF channel from the external environment.

11. The apparatus recited in claim 10 wherein the radiator enclosure comprises a flared notch radiator element.

12. The apparatus recited in claim 10 wherein the radiator enclosure comprises a conductively plated injection molded plastic radiator enclosure.

13. The apparatus recited in claim 10 wherein the carrier comprises an aluminum carrier.

14. The apparatus recited in claim 10 wherein the carrier provides a thermal path to transfer the heat generated by the circulator assembly.

15. The apparatus recited in claim 10 wherein the carrier comprises two holes for mounting coaxial input and output connectors.

16. The apparatus recited in claim 10 wherein the carrier comprises a threaded mounting hole for securing the circuit subassembly to an aperture plate.

17. The apparatus recited in claim 10 wherein the radiator enclosure comprises conductively plated injected molded thermoplastic material.

18. The apparatus recited in claim 10 wherein the radiator enclosure has a T-shaped tab on its end, which interlocks to a neighboring radiator assembly.

* * * * *